United States Patent [19]

Beauregard et al.

[11] Patent Number: 4,689,878

[45] Date of Patent: Sep. 1, 1987

[54] PTC HEATER AND METHOD OF MANUFACTURE

[75] Inventors: William W. Beauregard, Agawam; Peter J. Fessenden, East Longmeadow, both of Mass.

[73] Assignee: Springfield Wire, Inc., Springfield, Mass.

[21] Appl. No.: 289,499

[22] Filed: Aug. 3, 1981

[51] Int. Cl.[4] ..... H05B 3/00

[52] U.S. Cl. ..... 29/611; 29/613; 219/505; 219/534; 219/537; 219/544; 338/22 R; 338/328

[58] Field of Search ..... 29/611, 612, 613; 219/504, 505, 315, 523, 534, 537, 544, 541; 338/22 R, 332, 328

[56] References Cited

U.S. PATENT DOCUMENTS

| | | | |
|---|---|---|---|
| 2,937,354 | 5/1960 | Mazzarella et al. | 338/22 R |
| 4,104,509 | 8/1978 | Van Bokestal et al. | 338/22 R |
| 4,147,927 | 4/1979 | Pirotte | 338/22 R |

OTHER PUBLICATIONS

"Expanding Cartridge Improves Heat Transfer", Machine Design, p. 42, vol. 53, No. 7, Mar. 26, 1981.

*Primary Examiner*—Percy W. Echols

*Attorney, Agent, or Firm*—Chapin, Neal & Dempsey

[57] ABSTRACT

Crankcase heater including heat-generating electrical resistance elements and the method of manufacturing such heaters. The resistance elements include at least one positive temperature coefficient (PTC) heater element, platelet in form, adhesively bonded between a pair of metallic conductor-electrodes using an electrically conductive adhesive of high thermal conductivity. The electrodes formed for integral connection to electrically conductive lead wires serve as heat sinks dimensioned in length to provide a heater of predetermined wattage. The assembly of resistance elements, electrodes and lead wire connections are molded within the sheath of electrical insulation which is a silicone elastomer, having ceramic particles dispersed therein for enhanced thermal conductivity. The insulated heater is dimensioned in cross section so that when disposed within the well of a crankcase (compressor) its outer surface will leave a clearance which is less than thermal expansion of the silicone elastomer. Thus, when the heater is energized, its silicone sheath will expand into surface-to-surface contact with the surrounding well.

2 Claims, 4 Drawing Figures

PTC HEATER AND METHOD OF MANUFACTURE

BACKGROUND OF THE INVENTION

PTC heaters of varied constructions have been known for some time and they have generally been complex in construction involving various combinations of materials such as vitreous or ceramic potting compounds and spring-like elements for urging metallic terminals into contact with the PTC heating element. The following are typical of such patents: U.S. Pat. Nos. 3,214,719; 3,442,014; 3,564,199; 3,824,328; 3,835,434; 3,940,591; 3,996,447; 4,086,467; 4,104,509; 4,147,927.

It has been the usual practice in crankcase heaters, such as used in air conditioners, refrigerators and heat pumps to encapsulate the heaters in a rigid ceramic insulating body. To fit such rigid ceramic heaters into the rigid metallic wells of crankcases, it has been the practice to coat the ceramic with a thermally-conductive grease. The conductive grease is used to minimize the air space or clearance between the rigid outer heater surface and the wall of the crankcase well which, if not eliminated, would act as a thermal-insulating barrier to heat transfer.

The principal object of this invention is to provide a PTC-type crankcase heater of improved and simplified construction.

Another object of this invention is to provide a PTC type crankcase heater of the above type which lends itself to a simple and economical manufacturing process.

A further object of this invention is to provide an improved process for fabricating PTC-type crankcase heaters.

The above and other objects and advantages of this invention will become more readily apparent from a reading of the following description in connection with the accompanying drawing, in which.

DESCRIPTION OF THE PREFERRED EMBODIMENT

Figure 1:
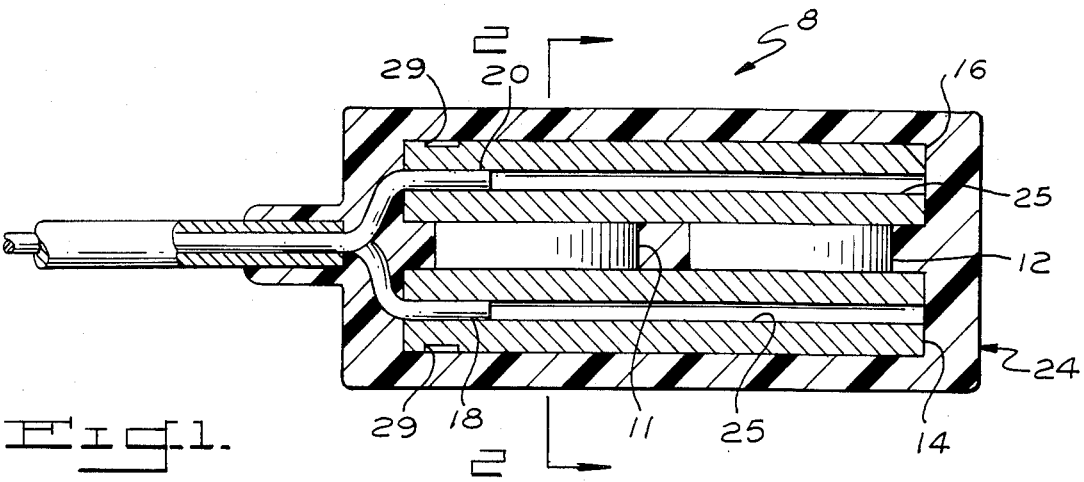
FIG. 1 is a side elevational view, in cross section, of a PTC heater of the type used in this invention.
Figure 3:
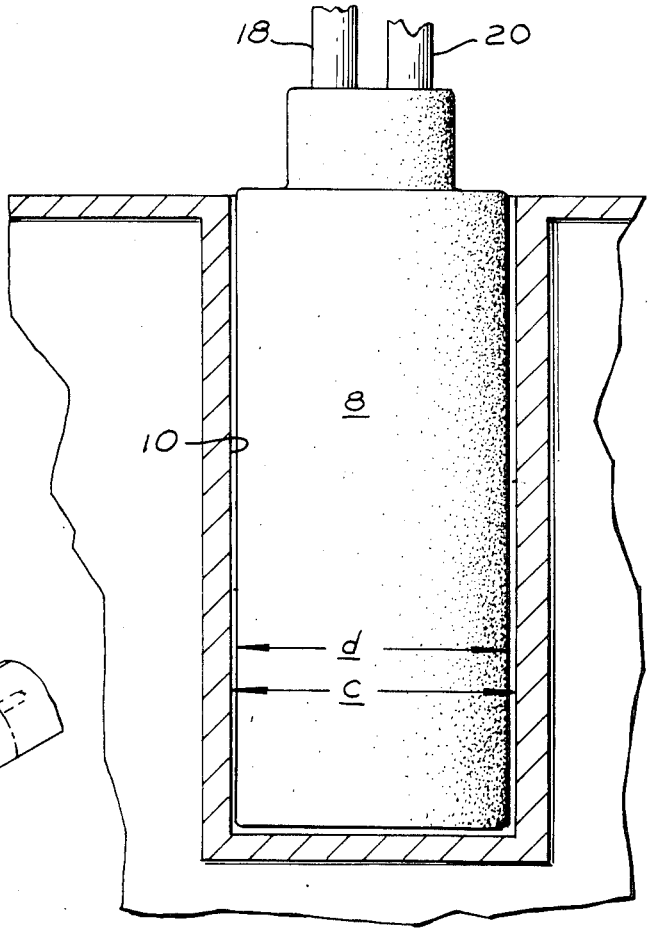
FIG. 3 is an elevational view of a crankcase heater embodying this invention; and, FIG. 4 is a perspective view illustrative of a step used in the manufacturing process embodying this invention.

Referring in detail to the drawings, a crankcase heater embodying this invention is shown generally at 8 in FIG. 3 disposed within the well 10 of a crankcase. The heater, as shown in FIG. 1, comprises one or more positive temperature coefficient (PTC) resistor elements 11 and 12 of platelet shape disposed with their flat sides in surface-to-surface contact with elongated metallic bar members 14 and 16 which serve as electrodes and heat sinks or thermal conductors.

Figure 2:
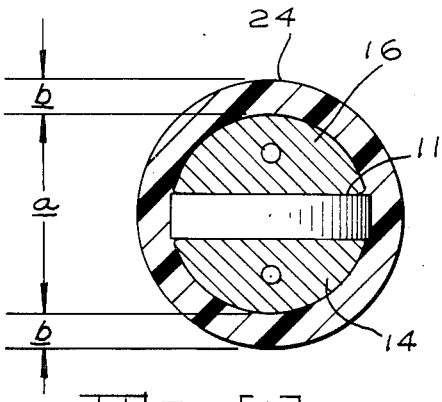
FIG. 2 is a section taken along line 2—2 of FIG. 1.

As best seen in FIG. 2, the conductor-electrodes are preferably of semi-cylindrical cross section and their inner flat surfaces abut the flat sides of the PTC elements 11 and 12. The electrodes may be any suitable metallic material such as aluminum which has good electrical and thermal conductivity. The electrodes may be fabricated as long extrusions illustrated at 17 in FIG. 4 and then cut transversely to individual electrode length.

The conductor wires of insulated cables 18 and 20 are connected in electrical contact with the metallic electrodes 14 and 16 whereby an electrical circuit is completed, for example, from the conductor wire 18 to electrode 14, PTC resistors 11 and 12, electrode 16 and back to the conductor 20 to complete the electrical circuit. This causes the PTC heater to be energized and thereby generate the heat which is transmitted to the metallic bars 14 and 16.

A moisture-impervious sheath 24 of electrical insulation encapsulates and seals the PTC heater elements, electrodes, and the lead wire connections. The sheath is preferably molded about the heater assembly and is an elastomer having good thermal conductivity. One such suitable material is a ceramic filled, thermally conductive silicone rubber which is available in liquid form. Upon molding, the silicone rubber cures to form a resilient casing of heat-resistant elastomer. The silicone rubber, is characterized by a large coefficient of thermal expansion. This is an important property because the insulated heating element is fabricated to be used in the tubular well 10 such as found in the crankcase of the compressor of an air conditioner, refrigerator or heat pump.

Because of its high coefficient of expansion, the sheath of the heater, when energized, will expand sufficiently to make firm and intimate surface-to-surface contact with the inner surface of the well 10. As a result, little or no air space will remain between the energized heater and the walls of the crankcase well. As a result, this combination provides superior heat transfer to the surrounding well 10 without the necessity of grease coating the outer surface of the heater to provide such a tight fit as was the customary practice when using rigid ceramic insulated crankcase heaters.

The heater construction embodying this invention lends itself to economical and efficient production techniques and when used in combination in a crankcase achieves superior thermal conductivity.

Figure 4:
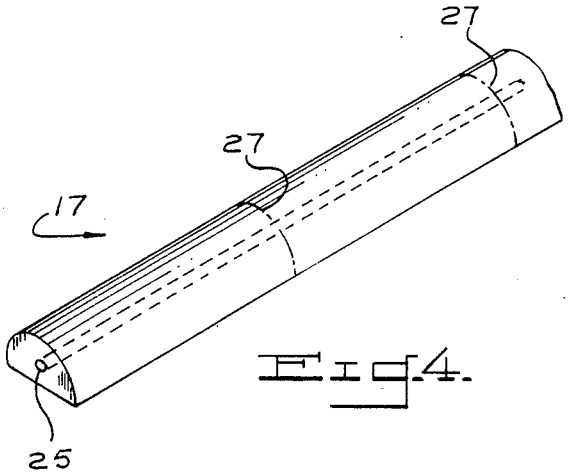

In fabrication, as shown in FIG. 4, the electrode/conductor bars 14 and 16 used in the heater construction may be extruded, as at 17, as a continuous length. The extrusion may include a slot or bore 25 formed therein and of a size to receive the ends of conductor wires 18 and 20 for ease of assembly. For use, the bar 17 is cut as at 27 into individual electrodes each having a predetermined length to provide a heater of the desired wattage. For a given PTC element, the wattage may be increased, for example, by simply increasing the length of the electrodes. Thus, heaters of various wattages can be fabricated using PTC elements of the same temperature rating.

Unlike a conventional resistance heater, a PTC heater operates at a wattage which varies depending upon the transfer of heat from the PTC element. Thus, to obtain optimum performance, a good thermal path must be provided from the element to the ambient medium. For crankcase heaters, this is most important because the primary reason for using such heaters is to obtain maximum wattage when heat is needed and minimum wattage when heat is not needed, such as when the compressor is operating. The wattage varies as heat is required and, thus, the efficiency of the heater depends upon effective heat transfer.

In assembly of the heater, two electrodes, each of semicylindrical cross section, are bonded to opposite sides of PTC heater elements 11 and 12 (FIG. 1). The bond is accomplished by using an adhesive composition which is characterized by excellent thermal and electrical conductivity, such as a silver filled epoxy resin. The ends of the metallic conduction wires are inserted in the bores 25 and readily staked or crimped into place as shown at 29. This integral connection provides a rigid subassembly having a predetermined diameter a (FIG. 2) so that after an insulating sheath of wall thickness b is applied, as best shown in FIG. 2, the final outer diameter of the heater (a+2b) will have a sliding interfit within the well 10, convenient for installation therein.

To insulate the heater, the rigid subassembly is inserted in a mold and liquid silicone rubber with ceramic particles dispersed therein is introduced into the mold and the silicone is cured to form an elastomeric sheath. The outer diameter d of the molded heater body equals a+2b and is such that it will fit easily but closely into the well 10 of the crankcase which has a diameter c. This leaves a clearance (c-d) less than the thermal expansion of the silicone when heated. Upon energization, the silicone sheath of the heater will expand sufficiently (Δb) to engage the well 10 of the crankcase. Thus, $a+2b+\Delta b=c$ whereby maximum heat transfer is achieved from the heating element to the well of the crankcase.

Having thus disclosed the invention, what is claimed is:

1. Method of manufacturing a heater element for use in a cylindrical metal casing of a crankcase heater comprising the steps of cutting an aluminum bar of semi-cylindrical cross-section, having a flat surface on one side thereof, into a plurality of discrete conductor members which are electrically and thermally conductive, the length of said conductor members being selected to provide a heater of predetermined wattage, forming a heater assembly by bonding the opposed flat surfaces of the conductor members to opposite sides of at least one positive temperature coefficient heater platelet using an electrically and thermally conductive adhesive and connecting lead wires to the ends of said conductor members, inserting said assembly into a mold having a cylindrical cavity and injecting silicone liquid containing a dispersion of ceramic particles into the mold cavity and curing the silicone to form an integral elastromeric sheath which encapsulates said assembly and is in surface contact with said members and the heater platelet, said sheath having an outer diameter, at room temperture, substantially less than the inner diameter of said metal casing and having a coefficient of expansion such that upon heating it will expand omnidirectionally to a diameter at least equal to that of said casing so that upon insertion of the silicone encapsulated heater assembly into the metal casing it will, when the heater is in operation, expand into overall elastic contact with the inner surface of said casing.

2. Method of manufacturing a heater element for use in a cylindrical metal casing of the crankcase heater as set forth in claim 8 in which said aluminum bar comprises an extrusion of continuous length which includes means to receive therein the end of the lead wires.

* * * * *